US010065225B2

(12) United States Patent
Brown

(10) Patent No.: US 10,065,225 B2
(45) Date of Patent: Sep. 4, 2018

(54) ROLLING MILL THIRD OCTAVE CHATTER CONTROL BY PROCESS DAMPING

(71) Applicant: Novelis Inc., Atlanta, GA (US)

(72) Inventor: Rodger Brown, Atlanta, GA (US)

(73) Assignee: NOVELIS INC., Atlanta, GA (US)

( * ) Notice: Subject to any disclaimer, the term of this patent is extended or adjusted under 35 U.S.C. 154(b) by 231 days.

(21) Appl. No.: 14/800,221

(22) Filed: Jul. 15, 2015

(65) Prior Publication Data

US 2016/0023257 A1 Jan. 28, 2016

Related U.S. Application Data

(60) Provisional application No. 62/029,031, filed on Jul. 25, 2014.

(51) Int. Cl.
*B21B 38/08* (2006.01)
*B21B 37/00* (2006.01)
(Continued)

(52) U.S. Cl.
CPC ..... *B21B 37/007* (2013.01); *B21B 1/22* (2013.01); *B21B 13/02* (2013.01); *B21B 35/00* (2013.01);
(Continued)

(58) Field of Classification Search
CPC ... B21B 2001/221; B21B 13/14; B21B 29/00; B21B 31/32; B21B 37/007; B21B 37/38;
(Continued)

(56) References Cited

U.S. PATENT DOCUMENTS 3,528,268 A 9/1970 Roberts
5,046,347 A 9/1991 Crosato et al.
(Continued)

FOREIGN PATENT DOCUMENTS

AT 507088 A4 2/2010
CN 203370829 U 1/2004
(Continued)

OTHER PUBLICATIONS

Farley, Tom, "Mill vibration during cold rolling", MPT Metallurgical Plant and Technology International, 2007, pp. 62-66, vol. 30, No. 1, Innoval Technology Limited, United Kingdom.
(Continued)

*Primary Examiner* — Edward Tolan
(74) *Attorney, Agent, or Firm* — Kilpatrick Townsend & Stockton LLP

(57) ABSTRACT

Control of third octave vibrations in a mill stand can be achieved using a high-speed piezoelectric assist coupled to a hydraulic gap cylinder to increase the damping of the roll stack. Vertical movements of the roll stack (e.g., the top work roll) can be determined through observation (e.g., measurement) of hydraulic fluid pressure of the hydraulic cylinder or entry tension of the metal strip. After determining vertical movements of the roll stack, a desired change in hydraulic pressure can be determined to overcome, reduce, or prevent third octave vibration. This desired change in hydraulic pressure can be effectuated at high speeds (e.g., at or above approximately 90 hertz) using the piezoelectric assist.

20 Claims, 7 Drawing Sheets

(51) Int. Cl.

| | |
|---|---|
| ***B21B 38/00*** | (2006.01) |
| ***B21B 38/06*** | (2006.01) |
| ***B21B 1/22*** | (2006.01) |
| ***B21B 13/02*** | (2006.01) |
| ***B21B 35/00*** | (2006.01) |

(52) U.S. Cl.
CPC ..... *B21B 38/008* (2013.01); *B21B 38/06* (2013.01); *B21B 38/08* (2013.01); *B21B 2203/44* (2013.01); *B21B 2265/06* (2013.01); *B21B 2265/12* (2013.01)

(58) Field of Classification Search
CPC ..... B21B 37/50; B21B 37/62; B21B 37/66; B21B 38/008; B21B 38/06; B21B 2203/44; B21B 2265/12; B21B 1/22; B21B 38/08; B21B 2265/06
See application file for complete search history.

(56) References Cited

U.S. PATENT DOCUMENTS

| | | | | |
|---|---|---|---|---|
| 5,142,891 | A * | 9/1992 | Kuwano | B21B 37/18 72/11.4 |
| 5,679,900 | A * | 10/1997 | Smulders | G01M 13/045 162/262 |
| 5,701,775 | A | 12/1997 | Sivilotti et al. | |
| 6,079,242 | A | 6/2000 | Allegro et al. | |
| 7,155,951 | B2 | 1/2007 | Farley et al. | |
| 8,302,445 | B2 * | 11/2012 | Pawelski | B21B 29/00 72/10.4 |
| 8,695,391 | B2 | 4/2014 | Keintzel et al. | |
| 9,156,070 | B2 | 10/2015 | Kaga et al. | |
| 2008/0243274 | A1 * | 10/2008 | Keintzel | F15B 9/09 700/69 |
| 2010/0161104 | A1 * | 6/2010 | Lofgren | B21B 37/007 700/109 |
| 2012/0000543 | A1 | 1/2012 | Keintzel et al. | |
| 2012/0235331 | A1 | 9/2012 | Lemay et al. | |
| 2013/0192324 | A1 * | 8/2013 | Vignolo | B21B 37/007 72/31.07 |
| 2016/0016215 | A1 | 1/2016 | Brown et al. | |

FOREIGN PATENT DOCUMENTS

| | | | | |
|---|---|---|---|---|
| CN | 1743091 | A | 3/2006 | |
| CN | 103717322 | A | 9/2016 | |
| DE | 10254958 | A1 | 6/2004 | |
| EP | 1457274 | A2 | 9/2004 | |
| EP | 2052796 | B1 | 8/2011 | |
| JP | S5467548 | A | 5/1979 | |
| JP | 59183924 | U | 10/1984 | |
| JP | S59183924 | A | 10/1984 | |
| JP | S63101013 | A | 5/1988 | |
| JP | 04182019 | A | 6/1992 | |
| JP | H05212410 | A | 8/1993 | |
| JP | H0796308 | A | 4/1995 | |
| JP | H08238510 | A | 9/1996 | |
| JP | H08238511 | A | 9/1996 | |
| JP | H08238512 | A | 9/1996 | |
| JP | 10-314816 | A * | 12/1998 | B21B 33/00 |
| JP | 2006130546 | A | 5/2006 | |
| JP | 2010094705 | A | 4/2010 | |
| JP | 2013010110 | A | 1/2013 | |
| JP | 2014113629 | A | 6/2014 | |
| KR | 20110097927 | A | 8/2011 | |
| WO | 9627454 | A1 | 9/1996 | |
| WO | 9727953 | A1 | 8/1997 | |
| WO | 0023204 | A1 | 4/2000 | |
| WO | 0249782 | A1 | 6/2002 | |
| WO | 2008062506 | A1 | 5/2008 | |
| WO | 2009153101 | A1 | 12/2009 | |
| WO | 2012046211 | A1 | 4/2012 | |

OTHER PUBLICATIONS

Farley, Tom, "Rolling Mill Vibration and its Impact on Productivity and Product Quality", Light Metal Age, 2006, pp. 12-14, vol. 64, No. 6, Innoval Technology Limited, United Kingdom.
"Vibration in Rolling Mills", Conference Papers, Nov. 9, 2006, 58 pages, IOM Communications Ltd, United Kingdom.
"Active Chatter Damping System", May 2013, 16 pages, Siemens VAI.
International Patent Application No. PCT/US2015/040561, International Search Report and Written Opinion dated Sep. 28, 2015, 11 pages.
International Patent Application No. PCT/US2015/040588, International Search Report and Written Opinion dated Oct. 1, 2015, 11 pages.
International Patent Application No. PCT/US2015/040561, International Preliminary Report on Patentability dated Jan. 26, 2017, 7 pages.
International Patent Application No. PCT/US2015/040588, International Preliminary Report on Patentability dated Feb. 9, 2017, 7 pages.
U.S. Appl. No. 14/800,074, Restriction Requirement dated Feb. 24, 2017, 6 pages.
Chinese Patent Application No. CN 201580040467.1, Office Action dated Jan. 12, 2018, 24 pages.
Japanese Patent Application No. 2017-504068, Office Action dated Mar. 6, 2018, 7 pages.
Canadian Patent Application No. 2,954,502, Office Action dated Nov. 29, 2017, 3 pages.
Korean Patent Application No. 10-2017-7005099, Office Action dated Jan. 4, 2018, 14 pages.

* cited by examiner

ROLLING MILL THIRD OCTAVE CHATTER CONTROL BY PROCESS DAMPING

CROSS REFERENCE TO RELATED APPLICATIONS

The present application claims the benefit of U.S. Provisional Patent Application No. 62/029,031 filed Jul. 25, 2014 entitled "ROLLING MILL THIRD OCTAVE CHATTER CONTROL BY PROCESS DAMPING," which is hereby incorporated by reference in its entirety.

TECHNICAL FIELD

The present disclosure relates to metalworking generally and more specifically to controlling vibrations in high-speed rolling mills.

BACKGROUND

Metal rolling, such as high-speed rolling, is a metalworking process used for producing metal strip. Resulting metal strip can be coiled, cut, machined, pressed, or otherwise formed into further products, such as beverage cans, automotive parts, or many other metal products. Metal rolling involves passing metal (e.g., a metal strip) through one or more mill stands, each having one or more work rolls that compress the metal strip to reduce the thickness of the metal strip. Each work roll can be supported by a backup roll.

During metal rolling, such as high-speed metal rolling, self-excited vibrations can occur on resonant frequencies of the mill. Specifically, each mill stand can vibrate in its own self-excited vibration. Self-excited vibration can be very prevalent in or around the range of approximately 100 Hz to approximately 300 Hz. This type of self-excited vibration can be known as "Third Octave" vibration because the frequency band of the mill's vibration coincides with the third musical octave (128 Hz to 256 Hz). This self-excited third octave vibration is self-sustaining vibration produced by the interaction between the rolls' spreading forces and the entry strip tension (e.g., tension of the strip in the direction of rolling as the strip enters the mill stand). Self-excited third octave vibration does not require energy to be delivered at the resonant frequency to excite the mill stand's natural resonance.

Self-excited third octave vibration can cause various problems in a mill. If left unchecked, self-excited third octave vibration can damage the mill stand itself, including the rolls, as well as damage any metal being rolled, rendering the metal unusable, and therefore scrap. Attempts have been made to counter self-excited third octave vibration by slowing the rolling speed the moment self-excited third octave vibration is detected. Such approaches can still cause wear to the mill stand and damage to the metal strip being rolled in small amounts, and can significantly slow the process of rolling the metal strip, reducing possible output of the mill.

SUMMARY

Certain aspects and features of the present disclosure relate to controlling third octave vibrations in a mill stand using a high-speed piezoelectric assist coupled to a hydraulic gap cylinder to increase the damping of the roll stack. Vertical movements of the roll stack (e.g., the top work roll) can be determined through observation (e.g., measurement) of hydraulic fluid pressure of the hydraulic cylinder or entry tension of the metal strip. After determining vertical movements of the roll stack, a desired change in hydraulic pressure can be determined and effectuated to overcome, reduce, or prevent third octave vibration. This desired change in hydraulic pressure can be effectuated at high speeds (e.g., at or above approximately 90 hertz) using the piezoelectric assist.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
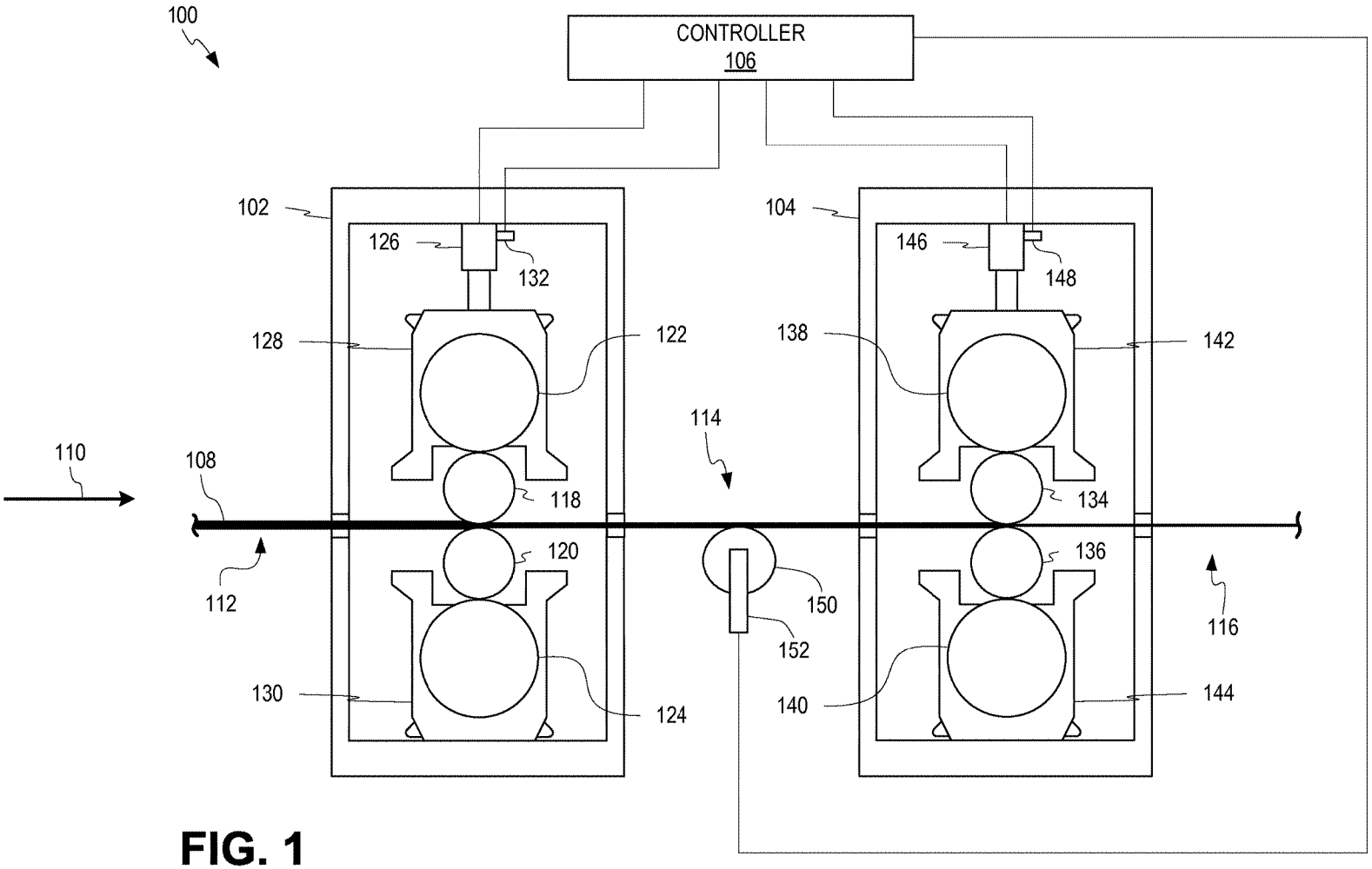
FIG. 1 is a schematic side view of a four-high, two-stand tandem rolling mill according to certain aspects of the present disclosure.

The subject matter of embodiments of the present disclosure is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Certain aspects and features of the present disclosure relate to controlling third octave vibrations in a mill stand using a high-speed piezoelectric assist coupled to a hydraulic gap cylinder to increase the damping of the roll stack. Vertical movements of the roll stack (e.g., the top work roll) can be determined through observation (e.g., measurement) of hydraulic fluid pressure of the hydraulic cylinder or entry tension of the metal strip. After determining vertical movements of the roll stack, a desired change in hydraulic pressure can be determined and effectuated to overcome, reduce, or prevent third octave vibration. This desired change in hydraulic pressure can be effectuated at high speeds (e.g., at or above approximately 90 hertz) using the piezoelectric assist.

Various aspects and features of the present disclosure can be used to control self-excited third octave vibration. Self-excited third octave vibration can include self-excited vibrations at or around 90-300 Hz. The various aspects and features of the present disclosure can be used to control self-excited third octave vibration in the range of approximately 90-200 Hz, 90-150 Hz, or any suitable ranges within the aforementioned ranges. The various aspects and features of the present disclosure can also be used to control tension disturbances at other frequencies.

Self-excited third octave vibration can occur on any rolling mill where the tension of the incoming strip to the roll gap is not precisely controlled and the strip speed is sufficiently high (e.g., sufficiently fast rolling speed). The concepts disclosed herein relate to control of strip tension as the strip enters a mill stand. As such, the concepts disclosed herein can be applied to a metal strip entering a mill stand from another piece of equipment, such as a decoiler. In addition, the concepts can be applied to a metal strip traveling between mill stands of a multiple-stand mill (e.g., a two, three, or more stand tandem cold mill).

For example, a two-stand tandem cold mill can include a tension zone the length of the metal strip in the inter-stand region. Tension can be created by the speed difference between the strip's entry speed into, and exit speed out of, the tension zone. The speed of the strip entering the zone may be set by the preceding stand's roll speed. The strip's speed out of the zone is determined by the downstream stand's roll speed and the roll gap of the downstream mill stand. On a two-stand tandem mill, the downstream gap can be controlled to achieve the sheet thickness required.

Inter-stand tension can be controlled by adjusting the difference between the roll speeds of the two stands and by adjusting the downstream stand's roll gap. Using either of these two adjustments to control inter-stand tension at the mill's chatter frequency (e.g., the frequency for self-excited third octave vibration) can be difficult, if not impossible. Adjusting roll speeds and roll gap can require movement of large masses and can require significant amounts of energy to mitigate chatter. It can be impractical and/or economically prohibitive to mitigate self-excited third octave vibration using these adjustments.

As an example, a two-stand tandem mill can be considered and modeled. In this mill, the second stand can experience self-excited third octave vibration, wherein the vertical movement of the second stack (x) as a function of the roll's separating force ($F_s$) can be described in the Laplace Domain as seen in Equation 1, below, where $K_1$ represents the spring constant that produces a separating force resulting from a change in stack movement (e.g., the mill's spring constant), $K_2$ represents the spring constant that produces an entry tension driven separating force resulting from a change in stack movement (e.g., stiffness of the inter-stand zone), s represents the Laplace operator, M represents the mass of the stack components that are moving (e.g., the top backup roll and the top work roll—the bottom work roll and the bottom backup roll can be stationary), D represents the natural damping coefficient of the stack and has a positive value, and $T_t$ represents the transit time taken for the strip to travel between stands (e.g., time to transit the inter-stand tension zone).

$$\frac{x}{F_S} = \frac{K_1(1+T_t s)}{(K_1+K_2)M(1+T_2 s)\left(s^2+\left(\frac{D}{M}-\frac{K-2}{K_1 T_t}\right)s+\frac{K_1}{M}\right)} \quad \text{Equation 1}$$

The key portion of the equation is the quadratic term in the denominator:

$$\left(s^2+\left(\frac{D}{M}-\frac{K_2}{K_1 T_t}\right)s+\frac{K_1}{M}\right).$$

This term represents the motion of a spring-mass system with damping of the form: $(s^2+2\delta\omega_n s+\omega_n^2)$. The natural frequency $\omega_n$ is determined by the system's mass and spring as $$\sqrt{\frac{K_1}{M}}$$

and the system's damping is dependent on the ratio, δ. In this case, the value of the damping ratio, δ, is related to the value of $$\left(\frac{D}{M}-\frac{K_2}{K_1 T_t}\right).$$

Therefore, the vertical movement of the stack can go into sustained oscillations (e.g., self-excited third octave vibration) when the value of damping, $$\left(\frac{D}{M}-\frac{K_2}{K_1 T_t}\right),$$

becomes negative. Therefore, it can be desirable to ensure the damping value remains positive.

The transit time variable ($T_t$) demonstrates why mill chatter can be associated with strip speed. As the mill speed rises, damping decreases and can become a negative value. Once the damping becomes negative, chatter can increase exponentially—assuming a linear system after chatter begins—until the strip breaks.

Eliminating a mill's resonant chatter frequency may not be possible or required. The mechanical structure of each mill stand determines that stand's resonant frequency. Therefore, it can be desirable to limit and/or prevent any changes to the mill's natural damping.

Prevention of changes in the mill's natural damping can be achieved by the creation of additional process damping. Damping can be added by controlling the rate of change of either entry strip tension or roll force cylinder pressure using a high speed roll force piezoelectric actuator.

Chatter can be produced by reduction of the damping associated with a mechanical resonance of the mill stack. By adding a fixed amount of damping greater than the reduction attributable to the change in mill speed, the process can remain stable, and such chatter does not occur and/or is reduced.

Damping can be added through use of an actuator that has a dynamic range greater than the chatter frequencies (e.g., 90-150 Hz, 90-200 Hz, or 90-300 Hz). An example of such an actuator can include piezoelectric devices acting on the volume of hydraulic fluid (e.g., oil) contained within the bore of a roll force hydraulic cylinder. Such an actuator can create a change in roll force by altering the volume of the containment vessel, which should not be confused with altering the amount of hydraulic fluid in the cylinder, which can be the general means of producing a force via an hydraulic actuator. The former can produce a force directly via a volume change whereas the latter can produce a force resulting from the addition of hydraulic fluid, which requires the integration of flow. The example actuator may not require physical integration.

Although piezoelectric devices generally produce a small change in volume, in combination with the bulk modulus of a hydraulic fluid such as oil and the dimensions of the roll force cylinder, the example actuator can produce force variation of approximately ±10 tons. Moreover, the example piezoelectric devices can produce this variation in roll force at frequencies up to several hundred hertz, which is greater than typical third octave chatter frequencies.

Various aspects of the present disclosure relate to determining the linear velocity of the roll stack. The linear velocity is the upwards and downwards movement of the roll stack, the work roll, the backup roll, a roll chock, and/or the hydraulic cylinder. The various aspects described herein can be implemented independently for each hydraulic cylinder supporting a work roll. For example, when force is being applied to a work roll via a pair of hydraulic cylinders associated with each end of the work roll (e.g., via a backup roll), each of the hydraulic cylinders can include independent systems for reducing chatter.

Linear velocity can be determined by measuring the roll force cylinder bore pressure or by measuring the entry strip tension. A piezoelectric actuator can produce a force proportional to the roll stack's linear velocity to provide additional damping. The additional damping can reduce or avoid self-excited third octave vibrations.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

FIG. 1 is a schematic side view of a four-high, two-stand tandem rolling mill 100 according to certain aspects of the present disclosure. The mill 100 includes a first stand 102 and a second stand 104 separated by an inter-stand space. Items to the left can be considered proximal to or upstream of items further to the right. For example, first stand 102 can be considered proximal to or upstream of the second stand 104. A strip 108 passes through the first stand 102, inter-stand space, and second stand 104 in direction 110. The strip 108 can be a metal strip, such as an aluminum strip. As the strip 108 passes through the first stand 102, the first stand 102 rolls the strip 108 to a smaller thickness. As the strip 108 passes through the second stand 104, the second stand 104 rolls the strip 108 to an even smaller thickness. The pre-roll portion 112 is the portion of the strip 108 that has not yet passed through the first stand 102. The inter-roll portion 114 is the portion of the strip 108 that has passed through the first stand 102, but has not yet passed through the second stand 104. The post-roll portion 116 is the portion of the strip 108 that has passed through both the first stand 102 and the second stand 104. The pre-roll portion 112 is thicker than the inter-roll portion 114, which is thicker than the post-roll portion 116.

The first stand 102 of a four-high stand includes opposing work rolls 118, 120 through which the strip 108 passes. Force is applied to respective work rolls 118, 120, in a direction towards the strip 108, by backup rolls 122, 124, respectively. Force can be applied to the backup rolls 122, 124 through roll chocks 128, 130, respectively, which function to support the backup rolls 122, 124.

Force can be applied through one or more linear actuators, such as hydraulic gap cylinders. In some cases, a high pressure hydraulic system feeds the hydraulic cylinders to position the work rolls to the correct gap to achieve the desired exit thickness. Force can be applied to the roll chocks 128, 130 to generate sufficient force to force the backup rolls 122, 124 against the work rolls 118, 120, and thus force the work rolls 118, 120 towards the strip 108. In some cases, force is applied through the top work roll 118 while the bottom work roll 120 is held vertically still, although force could be applied separately through the bottom work roll 120 instead or as well.

As seen in FIG. 1, force is being applied through the top work roll 118 by a pair of hydraulic cylinders 126. The amount of force being applied by the hydraulic cylinder 126 can determine the roll gap between the top work roll 118 and the bottom work roll 120, thus determining the amount of reduction achieved in the strip 108 between the pre-roll portion 112 and the inter-roll portion 114.

Similarly, the second stand 104 can include opposing work rolls 134, 136 supported by backup rolls 138, 140, which are in turn supported by roll chocks 142, 144, respectively. A pair of hydraulic cylinders 146 can provide force through the top work roll 134. Other variations, similar to the first stand 102, can be used. The amount of force being applied by the hydraulic cylinder 146 can determine the roll gap between the top work roll 134 and the bottom work roll 136, thus determining the amount of reduction achieved in the strip 108 between the inter-roll portion 144 and the post-roll portion 116.

The backup rolls provide rigid support to the work rolls. In alternative cases, force is applied directly to a work roll, rather than through a backup roll. In alternative cases, other numbers of rolls, such as work rolls and/or backup rolls, can be used.

A controller 106 can be coupled to the first stand 102 and the second stand 104 to control the actuation of the hydraulic cylinders 126, 146. Piezoelectric assists 132, 148 can be coupled to the hydraulic cylinders 126, 146 of the first stand 102 and second stand 104, respectively. Each hydraulic cylinder 126, 146 includes hydraulic fluid, such as oil, within a fluid chamber (e.g., the space in which the oil resides). The piezoelectric assist functions to rapidly change the pressure being exerted by the hydraulic cylinder by rapidly changing the volume of the containment space. An example piezoelectric assist is a piezoelectric actuator available from ERAS GmbH of Goettingen, Germany. Each piezoelectric assist 132, 148 is operable to rapidly change the volume of its respective hydraulic cylinder 126, 146. Each piezoelectric assist 132, 148 can be located at or near the respective stands 102, 104 or distant from them, as long as they are hydraulically coupled to their respective hydraulic cylinders 126, 146.

As the strip 108 passes through a stand (e.g., first stand 102 or second stand 104), self-excited third octave vibrations (e.g., chatter) can occur. Even before strong chatter occurs, movement of the strip 108 past the work rolls can cause fluctuations in the rolling gap (e.g., gap between the top work roll and bottom work roll). These fluctuations can lead to chatter or, if left without correction, can be chatter.

Chatter can thus be controlled by reducing these fluctuations, such as by increasing the natural damping of the mill stand.

For example, the piezoelectric assist 148 can cause rapid (e.g., above approximately 90 Hz), changes in the volume of the hydraulic cylinder 146, thus inducing rapid changes in the amount of force being applied through the work roll 134. Since actuation of the piezoelectric assist 148 to change the volume of the hydraulic cylinder 146 does not require oil flow (e.g., through a servo-valve), it can be accomplished rapidly (e.g., above approximately 90 Hz). The controller 106 can determine vertical movement of the work roll 134 and then drive the piezoelectric assist 148 as necessary to account for that vertical movement to maintain positive damping. Vertical movement of the work roll 134 can be equated to vertical movement of the backup roll 142 or roll chock 138, as well as a change of distance of the roll gap. Vertical movement of the work roll 134 can be determined in various ways as described herein, including through monitoring of hydraulic pressure of the hydraulic cylinder or monitoring of the entry tension of the strip 108 (e.g., tension as the strip enters the stand 104).

One or more tension measuring devices can be used to measure strip entry tension (e.g., tension of the strip as it enters the roll bite between a pair of work rolls). Any suitable tension measuring device can be used. Strip entry tension can be measured in a tension zone (e.g., a zone between the mill stand into which the strip is entering and a preceding piece of tension-providing equipment, such as an earlier mill stand or a decoiler and/or bridle). As seen in FIG. 1, a roller 150 coupled to a pair of force transducers 152 (e.g., one on each end of the roller 150) can be used to measure tension in the strip 108 in the inter-stand region. Other tension measuring devices can be used. Tension measuring devices can be used before any mill stand.

While a two-stand tandem mill is shown in FIG. 1, any number of stands can be used.

Figure 2:
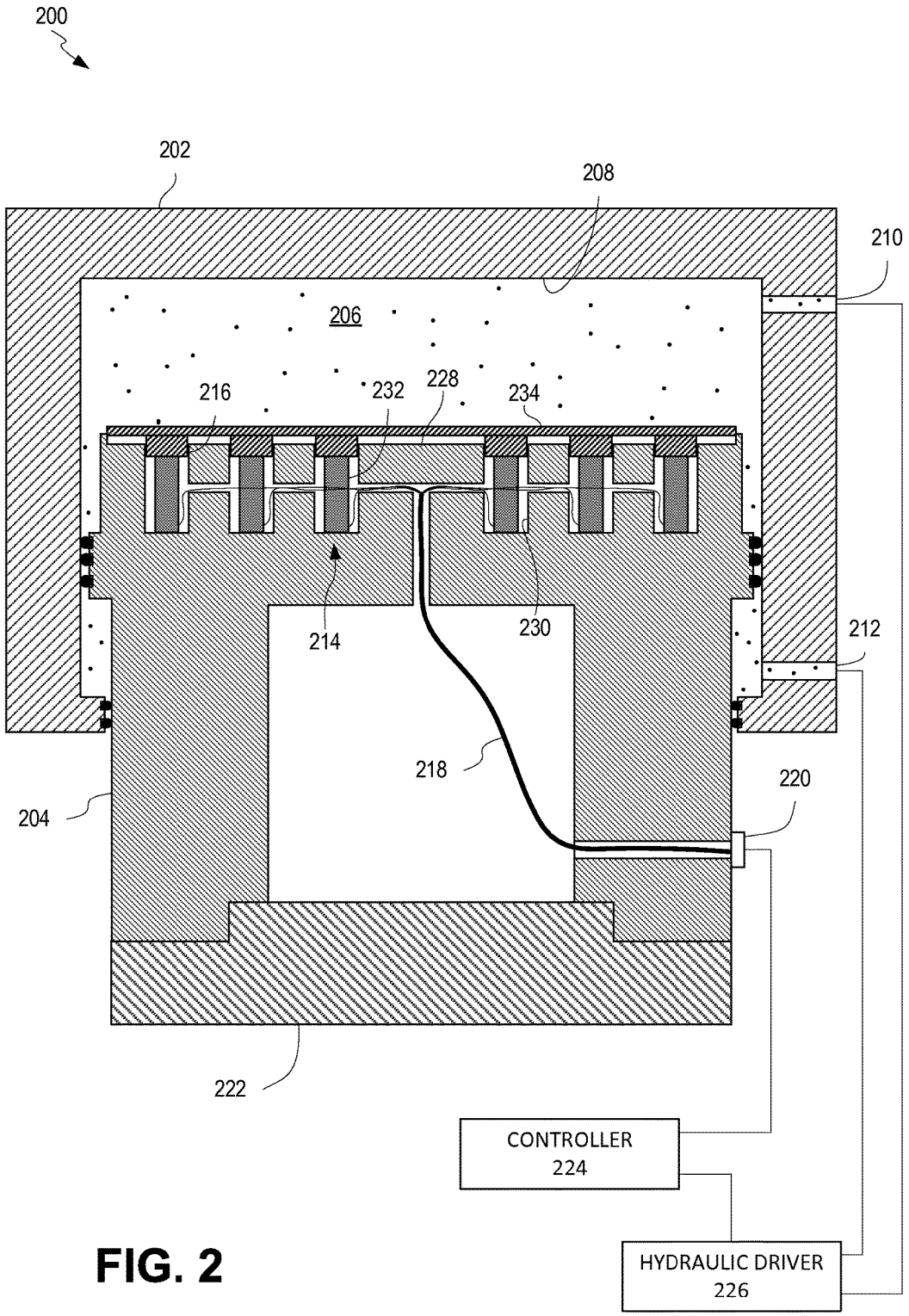
FIG. 2 is a cross-sectional view of a hydraulic actuator with piezoelectric assists in an extended state according to certain aspects of the present disclosure.

FIG. 2 is a cross-sectional view of a hydraulic actuator 200 with piezoelectric assists 214 in an extended state according to certain aspects of the present disclosure. The hydraulic actuator 200 can be the hydraulic cylinders 126, 146 of FIG. 1. The hydraulic actuator 200 can include a cylinder body 202 supporting a piston 204 therein. The cylinder body 202 includes a driving cavity 208 (e.g., fluid chamber) into which hydraulic fluid 206 can be circulated to manipulate the piston 204. Hydraulic fluid 206 can be circulated by a hydraulic driver 226 (e.g., servo-valves and/or other parts) controllable by controller 224 (e.g., such as controller 106 of FIG. 1). Hydraulic fluid 206 can be circulated through cylinder ports 210, 212 in order to raise or lower the piston 204.

The piston 204 can include a piston head 228 having one or more recesses 230. Piezoelectric assists 214 can be located within each recess 230. In some cases, multiple recesses 230 can be spread across the entire piston head 228 in order to maximize an amount of surface area actuatable by the piezoelectric assists 214. In alternate cases, piezoelectric assists can be located elsewhere besides the piston head as long as the piezoelectric assist is able to change the volume of the driving cavity 208.

As seen in FIG. 2, each piezoelectric assist 214 includes a piezoelectric device 232 (e.g., a piezoelectric stack) coupled to a sub-piston 216. The sub-piston 216 acts like a piston within the recess 230, moving axially to adjust the position of an end plate 234. Multiple sub-pistons 216 can act on a single end plate 234 in order to provide more actuation force. In some cases, no end plate 234 is used or multiple end plates 234 are used. Movement of the sub-pistons 216 can cause change in the volume of the driving cavity 208, such as through movement of an end plate 234.

As an electrical current is applied to a piezoelectric device 232, the piezoelectric device 232 can deform to either extend or retract, thus pushing or pulling on the sub-piston 216, which can then push or pull on the end plate 234. Opposite electrical current can be applied to deform the piezoelectric device 232 in the opposite direction. When the piezoelectric assists 215 are in an extended state, they have decreased the volume of the driving cavity 208.

Wiring 218 can couple each piezoelectric device 232 to controller 224 through a wiring port 220. Optionally, a piezoelectric driver can drive the piezoelectric devices 232 and the piezoelectric deriver can be controlled by the controller 224. An internal recess of the piston 204 can be covered by an end cap 222, which is coupled to the piston 204.

Because piezoelectric devices 232 can operate at very high frequencies, the piezoelectric assist 214 can increase the speed with which a hydraulic actuator 200 can function. A single hydraulic actuator 200 can include one or more piezoelectric assists 214.

To accommodate high frequency tension disturbances, the piezoelectric actuator can be placed between the valve and the cylinder. The piezoelectric assist can change the volume of hydraulic fluid as a function of hydraulic fluid pressure. The length of the piezoelectric device changes as the pressure varies.

Figure 3:
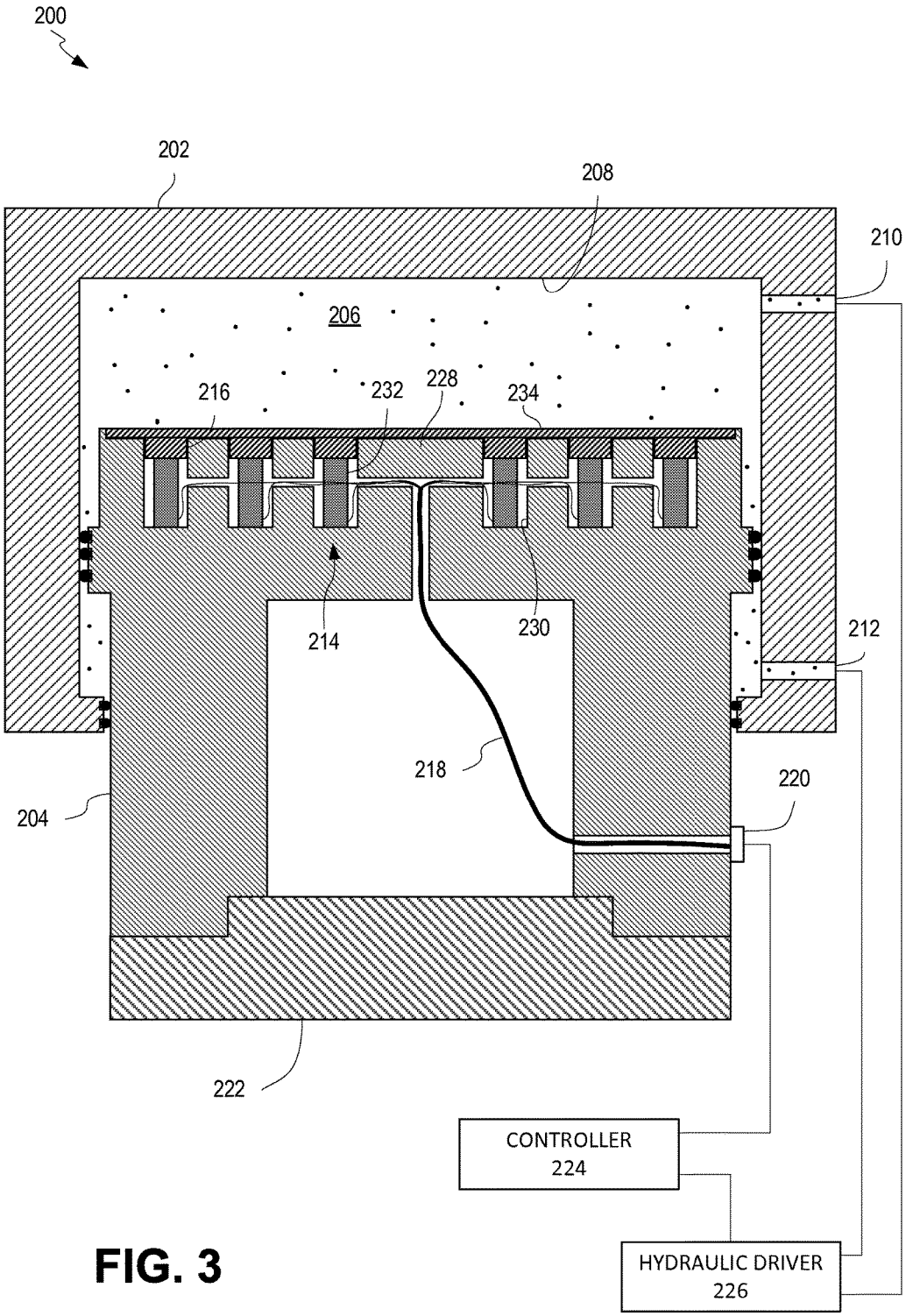
FIG. 3 is a cross-sectional view of the hydraulic actuator of FIG. 2 with piezoelectric assists in a retracted state according to certain aspects of the present disclosure.

FIG. 3 is a cross-sectional view of the hydraulic actuator 200 of FIG. 2 with piezoelectric assists 214 in a retracted state according to certain aspects of the present disclosure. Actuation of the piezoelectric devices 232 within the piezoelectric assists 214 can force the sub-pistons 216 to retract into the recesses 230 of the piston head 228, thus reducing the effective volume of the driving cavity 208. When an end plate 234 is used, retraction of the sub-pistons 216 cause retraction of the end plate 234, thus reducing the effective volume of the driving cavity 208.

When the sub-pistons 216 retract to reduce the effective volume of the driving cavity 208, the piston 204 and end cap 222 must move inwards with respect to the cylinder body 202 (e.g., upwards in FIGS. 2-3), especially when the hydraulic fluid 206 is incompressible. Hydraulic fluid 206 can be allowed to flow between the cylinder ports 210, 212 of the cylinder body 202. The controller 224 can continue to control the hydraulic driver 226 and can control the piezoelectric devices 232 via wiring 218 through the electrical port 220.

This small amounts of linear movement achieved through actuation of the piezoelectric assists 214, such as between an extended state (e.g., FIG. 2) and a retracted state (e.g., FIG. 3) can occur at extremely fast speeds (e.g., at or above approximately 90 hertz). Because the piezoelectric assists 214 are positioned between the hydraulic fluid 206 and the piston 204, movement of hydraulic fluid 206 is minimal in order to effectuate movement of the piston 204.

Figure 4:
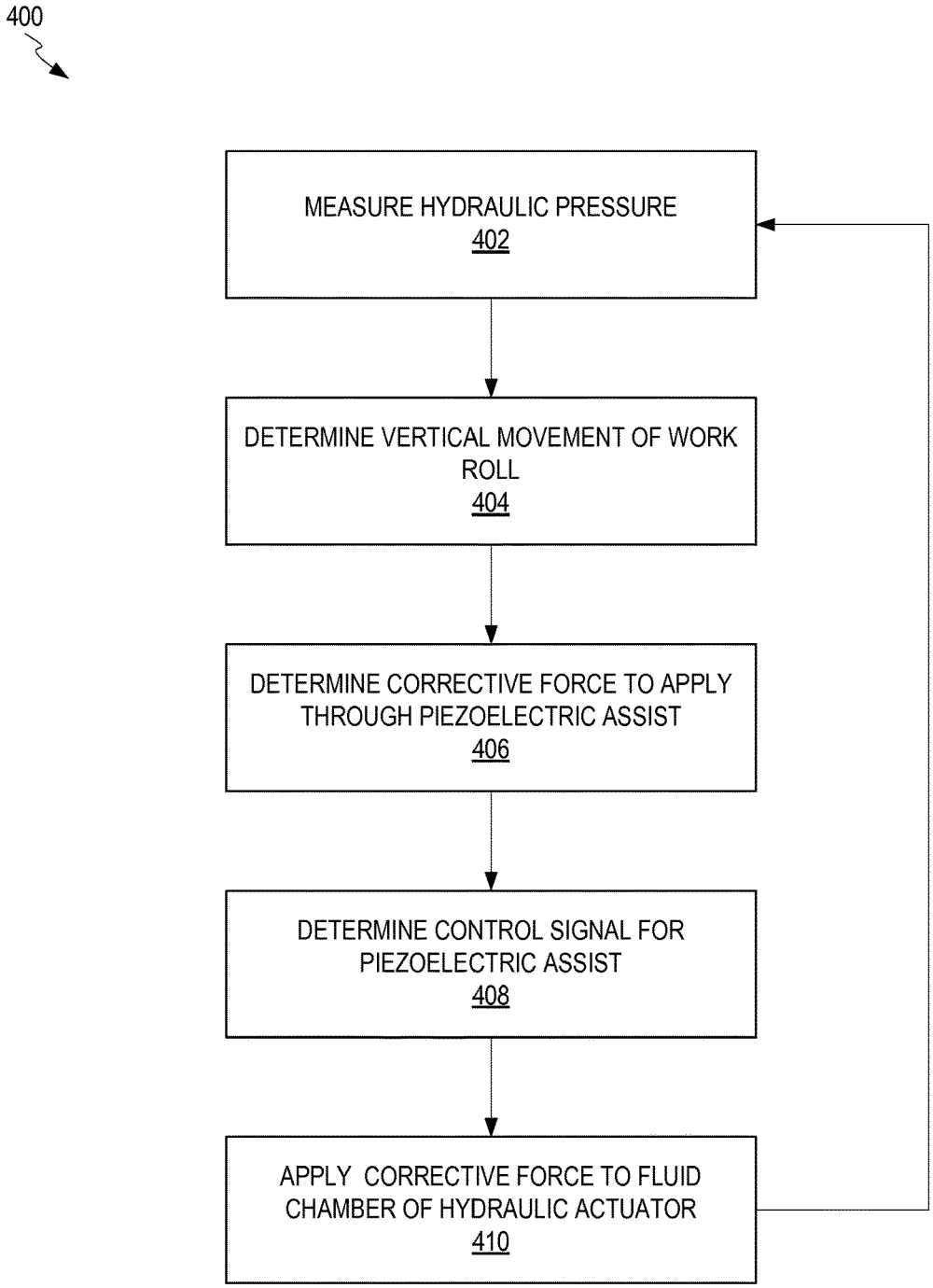
FIG. 4 is a flowchart depicting a process of reducing chatter by monitoring pressure in a hydraulic cylinder according to certain aspects of the present disclosure.

FIG. 4 is a flowchart depicting a process 400 of reducing chatter by monitoring pressure in a hydraulic cylinder according to certain aspects of the present disclosure. Process 400 can be used with respect to any of the hydraulic cylinders of a mill stand, including the stands of FIG. 1.

At block 402, hydraulic pressure in the hydraulic cylinder is measured. At block 404, the vertical movement of the work roll is determined based on the measured hydraulic pressure in the hydraulic cylinder. The vertical movement of the work roll can be calculated as described herein. The vertical movement of the work roll can be approximately the same as the vertical movement of the hydraulic cylinder (e.g., rod of the hydraulic cylinder).

At block 406, the amount of corrective force to apply through the piezoelectric assist is determined. This determination can be calculated to maintain a positive amount of damping. At block 408, a control signal for the piezoelectric assist is determined based on the amount of corrective force necessary to be applied through the piezoelectric assist. At block 410, the corrective force is applied to the fluid chamber of the hydraulic actuator by the piezoelectric assist. The control signal, when received by the piezoelectric assist, causes the piezoelectric assist to deform to increase or decrease the volume of the fluid chamber of the hydraulic actuator, thus increasing or decreasing the pressure within the hydraulic cylinder.

In some cases, the process 400 can repeat until stopped to continuously control chatter. A single mill stand (e.g., stand 102 of FIG. 1) can perform process 400 on each of its hydraulic cylinders, such as on each of a pair of hydraulic cylinders supplying force to opposite ends of a work roll.

Figure 5:
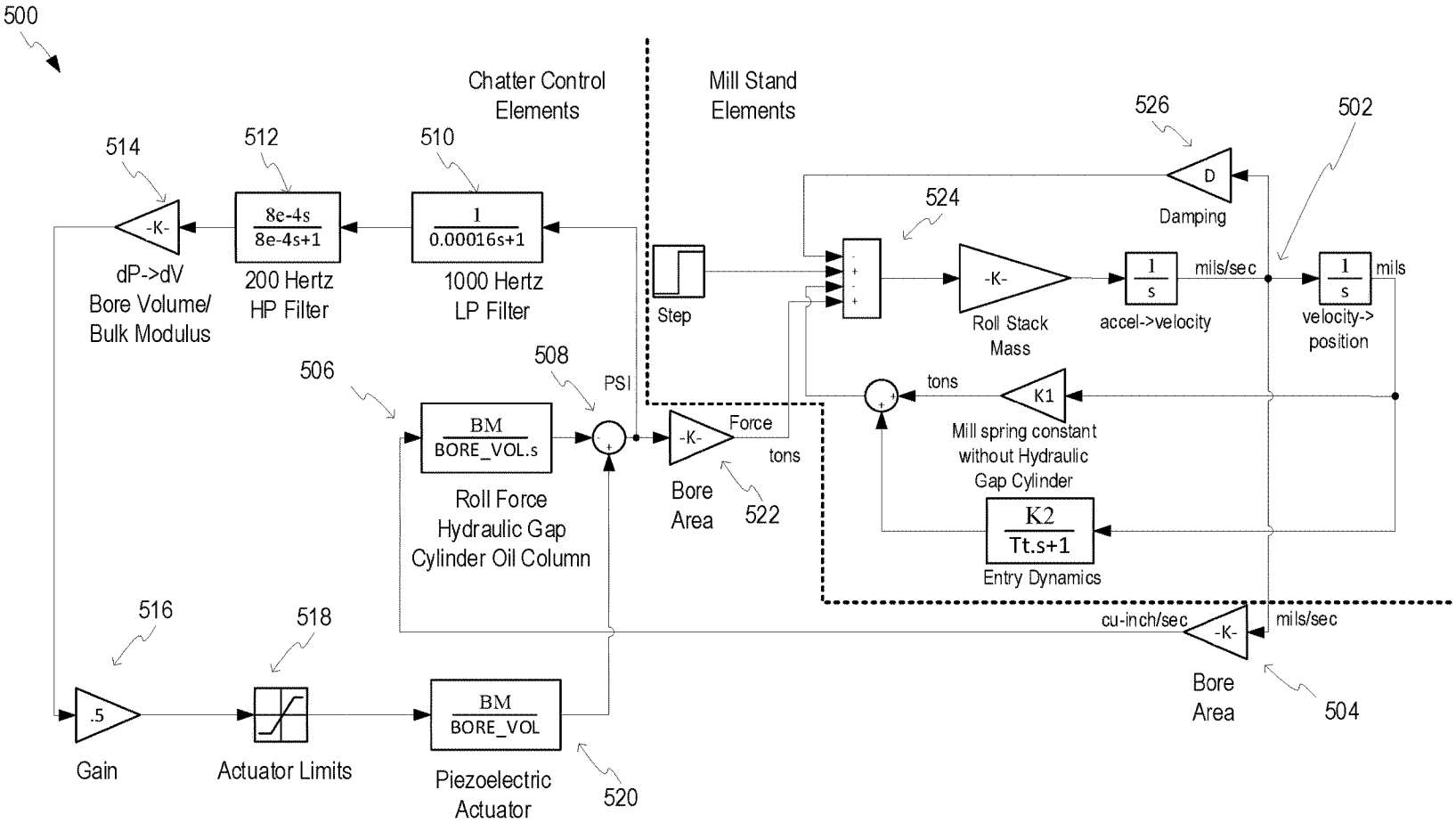
FIG. 5 is a block diagram depicting a mathematical model for determining an amount of damping force necessary based on stack velocity determined through monitoring of pressure in a hydraulic cylinder according to certain aspects of the present disclosure.

FIG. 5 is a block diagram depicting a mathematical model 500 for determining an amount of damping force necessary based on stack velocity determined through monitoring of pressure in a hydraulic cylinder according to certain aspects of the present disclosure. Model 500 is an example model, and thus changes or variations to the model can be made without deviating from the concepts of the present disclosure. The concepts disclosed below with regard to model 500 can be applied to a mill stand (e.g., stand 102 of FIG. 1), such as through process 400 of FIG. 4. As seen in FIG. 5, the elements to the right of the dotted line represent a model of the mill stand elements, while the elements to the left of the dotted line represent a model of the chatter control elements. In some cases, the Roll Force Hydraulic Gap Cylinder Oil Column can be considered a mill stand element.

Bore pressure of the hydraulic cylinder (e.g., roll force cylinder or cylinder 126 of FIG. 1) can be used to determine cylinder velocity (e.g., vertical movement of the cylinder or the work roll) in control schemes for controlling cylinder position. The change in bore pressure is related to the change in bore volume as seen in Equation 2, where ΔP represents the change in pressure, $B_m$ represents the bulk modulus of the hydraulic fluid, Δv represents the change in bore volume, and V represents the nominal volume of the hydraulic fluid at that point in time.

$$\Delta P = -B_m \times \frac{\Delta v}{V} \qquad \text{Equation 2}$$

Expanding Equation 2 results in the relationship between cylinder velocity and the rate of change of cylinder pressure as seen in Equation 3, where $\dot{x}$ represents the linear velocity of the cylinder, A represents the area of the cylinder, and P represents the change in pressure over time.

$$\dot{x} = \frac{V}{B_m A} \times \dot{P} \qquad \text{Equation 3}$$

The model 500 accounts for this relationship by taking a signal representing the linear velocity of the roll stack at point 502 and multiplying it by the bore area at 504, and then multiplying it by the bulk modulus of the hydraulic fluid over the nominal volume of the hydraulic fluid at 506. The resultant pressure signal can be input to summation block 508.

The pressure signal from summation block 508 can be passed through a low pass filter (e.g., a 1000 Hz low pass filter) at 510 and then through a high pass filter (e.g., a 200 Hz high pass filter) at 512. The resultant signal can be multiplied by the bore volume over the bulk modulus at 514 to determine a velocity signal. This velocity signal is representative of the observed linear velocity of the cylinder and/or work roll. The velocity signal can be optionally multiplied by an adjustable gain at 516. The resultant signal can be supplied to an actuator limit function at 518 to determine an actuator signal resulting in a certain amount of force. The actuator signal can be used by the actuator to change the bore volume. The force can be multiplied by the bulk modulus over the nominal volume at 520 to determine the pressure change imparted by actuation of the piezoelectric actuator (e.g., piezoelectric assist). This pressure signal can be sent to the summation block 508.

The model 500 completes by taking the pressure signal from the summation block 508, multiplying it by the bore area at 522, and reintroducing it back into the mill stand elements at summation block 524, where it provides additional damping in addition to any natural damping modeled at 526.

The loop equation for determining what force to apply through the piezoelectric actuator is seen in Equation 4, where $F_D$ represents the force produced by the piezoelectric actuator, and $K_c$ represents the control loop gain.

$$\frac{F_D}{\dot{x}} = A \times \frac{B_m}{V_S} \times \frac{8 \times 10^{-4} s}{1 + 8 \times 10^{-4} s} \times \frac{V}{B_m} \times K_c \times \frac{B_m}{V} \times A \qquad \text{Equation 4}$$

Equation 4 can be reduced to Equation 5, below.

$$\frac{F_D}{\dot{x}} = K_C \times \frac{A^2 B_M}{V} \times \frac{8 \times 10^{-4}}{(1 + 8 \times 10^{-4} s)} \qquad \text{Equation 5}$$

The transfer function relating the damping force to cylinder velocity can include only a low-pass filter. Therefore, the additional damping factor can be considered as a constant, as seen in Equation 6.

$$D = \frac{F_D}{\dot{x}} = K_C \times \frac{A^2 B_M}{V} \qquad \text{Equation 6}$$

Therefore, the piezoelectric assist, which adjusts the nominal volume of the hydraulic cylinder, can be used to keep damping (D) positive.

Figure 6:
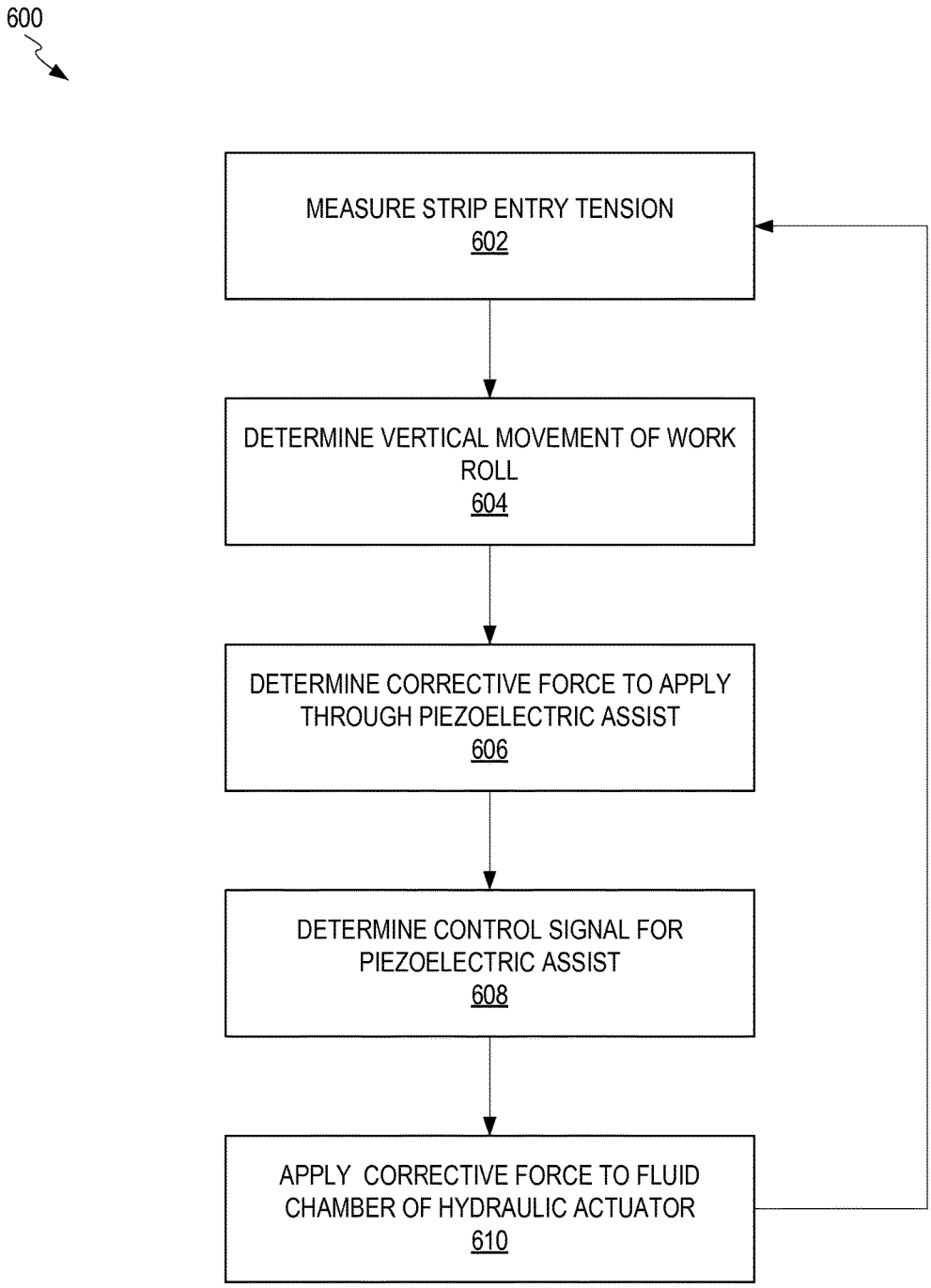
FIG. 6 is a flowchart depicting a process of reducing chatter by monitoring strip entry tension in a mill stand according to certain aspects of the present disclosure.

FIG. 6 is a flowchart depicting a process 600 of reducing chatter by monitoring strip entry tension in a mill stand according to certain aspects of the present disclosure. Process 600 can be used with respect to any or all of the hydraulic cylinders of a mill stand, including the stands of FIG. 1.

At block 602, strip entry tension is measured. Strip entry tension is the tension of the metal strip as it enters the bite between the work rolls of a mill stand. Strip entry tension can be measured in any suitable way, including through the use of a pressure-sensing roller and/or a roller supported by load cells. Other ways of measuring strip entry tension can be used. At block 604, the vertical movement of the work roll is determined based on the measured entry strip tension. The vertical movement of the work roll can be calculated as described herein. The vertical movement of the work roll can be approximately the same as the vertical movement of the hydraulic cylinder (e.g., rod of the hydraulic cylinder).

At block 606, the amount of corrective force to apply through the piezoelectric assist is determined. This determination can be calculated to maintain a positive amount of damping. At block 608, a control signal for the piezoelectric assist is determined based on the amount of corrective force necessary to be applied through the piezoelectric assist. At block 610, the corrective force is applied to the fluid chamber of the hydraulic actuator by the piezoelectric assist. The control signal, when received by the piezoelectric assist, causes the piezoelectric assist to deform to increase or decrease the volume of the fluid chamber of the hydraulic actuator, thus increasing or decreasing the pressure within the hydraulic cylinder.

In some cases, the process 600 can repeat until stopped to continuously control chatter. A single mill stand (e.g., stand 102 of FIG. 1) can perform process 600 on each or all of its hydraulic cylinders.

Figure 7:
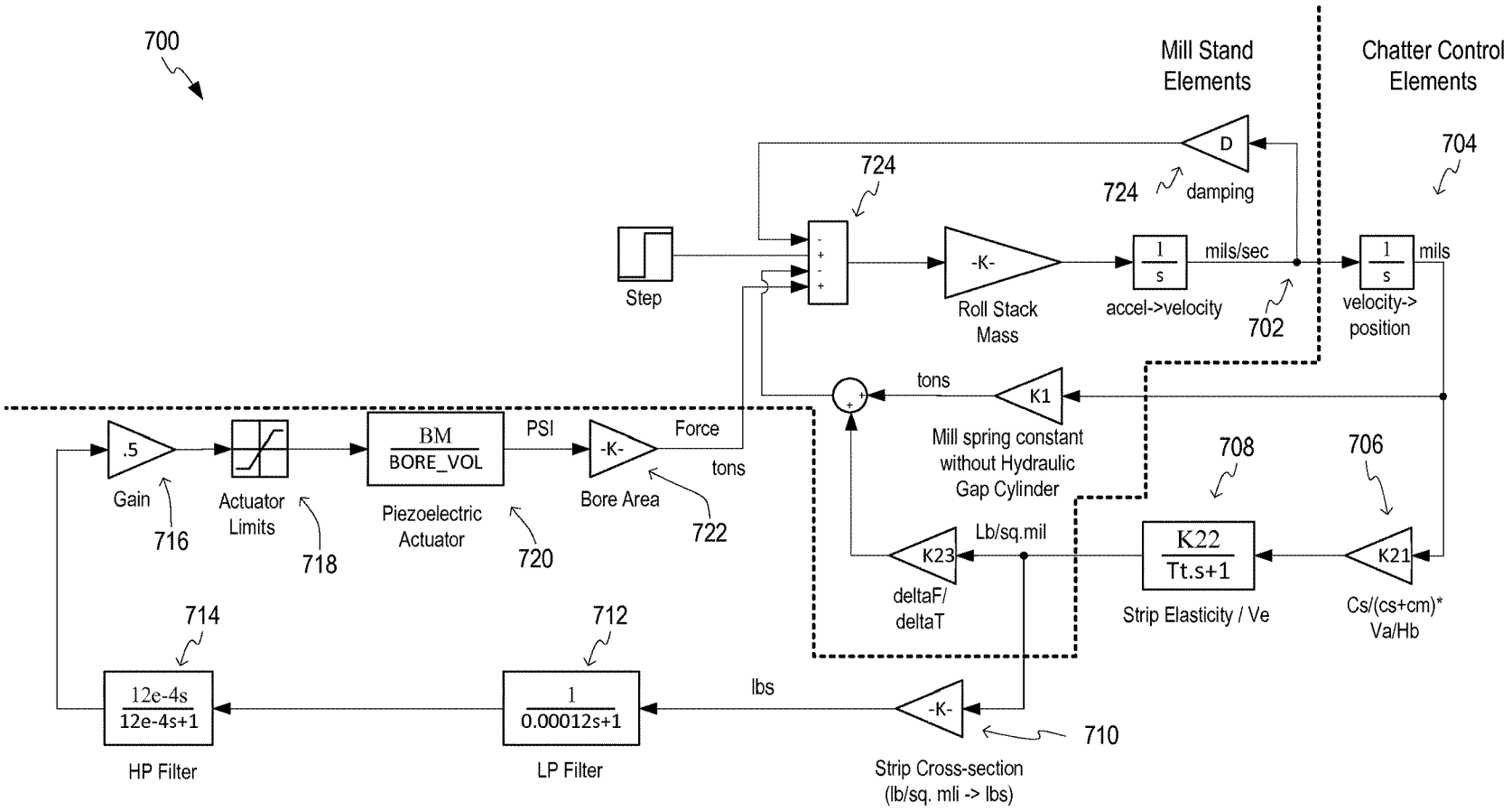
FIG. 7 is a block diagram depicting a mathematical model for determining an amount of damping force necessary based on stack velocity determined through monitoring of strip entry tension according to certain aspects of the present disclosure.

FIG. 7 is a block diagram depicting a mathematical model 700 for determining an amount of damping force necessary based on stack velocity determined through monitoring of strip entry tension according to certain aspects of the present disclosure. Model 700 is an example model, and thus changes or variations to the model can be made without deviating from the concepts of the present disclosure. The concepts disclosed below with regard to model 700 can be applied to a mill stand (e.g., stand 102 of FIG. 1), such as through process 600 of FIG. 6. As seen in FIG. 7, the elements to the right of and below the dotted line represent a model of the chatter control elements, while the elements to the left of and above the dotted line represent a model of the mill stand elements.

Strip entry tension (e.g., the tension of the metal strip as it enters the bite between work rolls of a mill stand) is related to the stack velocity (e.g., linear velocity of the work roll or hydraulic cylinder). As the roll gap opens and closes, the velocity of the strip changes as dictated by conservation of mass. The roll gap produces a strip thickness variation forcing a change in entry strip speed according to Equation 7, where $\Delta v_e$ represents the change in entry speed, $\Delta h_x$ represents the change in exit thickness, $V_x$ represents the exit strip velocity, and $H_e$ represents the entry strip thickness. Strip width can be ignored since the strip width changes are typically negligible during cold rolling.

$$\Delta v_e = \Delta h_x \frac{V_x}{H_e} \qquad \text{Equation 7}$$

The velocity change produces a small change in entry strip strain, which can be expressed according to Equation 8, where L represents the length of the tension zone and Ve represents the average velocity of the strip in the tension zone (e.g., the inter-stand region).

$$\Delta v_e = \frac{\Delta v / V_e}{\left(1 + \frac{L}{V_e} s\right)} \qquad \text{Equation 8}$$

The ratio of strip length and strip speed represents the transit time of the strip in the tension zone.

A change in strip stress can be measured by any suitable tension measurement device. The signal corresponding to tension can be mathematically differentiated and the result can drive the piezoelectric assist to change the volume of the fluid chamber of the hydraulic cylinder.

Model 700 accounts for this relationship between the strip tension and the damping of the mill stand. A signal representing the linear velocity of the roll stack is taken at point 702 and integrated to determine position at 704. The resultant signal is multiplied by a constant at 706 and then multiplied by the strip elasticity over the entry speed at 708 to determine a stress signal. At 708, $T_t$ is the transport delay in the tension zone (e.g., one second if the length is five meters and the speed is five m/s). 708 takes into account changes in gauge of the strip exiting the mill, as changes in gauge will affect the strip elasticity. At 710, the stress signal is multiplied by the strip cross-section to determine a force signal. The force signal can be passed through a low pass filter at 712 and a high pass filter at 714 to determine a velocity signal. This velocity signal is representative of the observed linear velocity of the cylinder and/or work roll. The velocity signal can be optionally multiplied by an adjustable gain at 716. The resultant signal can be supplied to an actuator limit function at 718 to determine an actuator signal resulting in a certain amount of force. The actuator signal can be used by the actuator to change the bore volume. The force can be multiplied by the bulk modulus over the nominal volume at 720 to determine the pressure change imparted by actuation of the piezoelectric actuator (e.g., piezoelectric assist). This pressure signal can be multiplied by the bore area at 722 to determine a force signal.

The model 700 completes by taking the force signal from 722 and reintroducing it back into the mill stand elements at summation block 724, where it provides additional damping in addition to any natural damping modeled at 726.

Thus, a tension measurement device can be used to measure tension in the strip and the measured tension can be used to determine a force to apply through the piezoelectric assist.

Neglecting the transducer filter, the loop equation shown in Equation 9.

$$D = \frac{F_D}{\dot{x}} = \frac{1}{s} \times \frac{K_{21} K_{22}}{(1 + T_t s)} \times \frac{12 \times 10^{-4} s}{(1 + 12 \times 10^{-4} s)} \times K_c \times \frac{B_m}{V} \qquad \text{Equation 9}$$

Canceling the integration of the velocity by the derivative feature of the controller can produce a damping force proportional to roll gap velocity in the frequency range of interest.

Therefore, the piezoelectric assist, which adjusts the nominal volume of the hydraulic cylinder, can be used to keep damping (D) positive.

In some cases, chatter can be thusly mitigated by providing process damping. Process damping can be a force proportional to the vertical speed of the roll stack. Either roll force hydraulic actuator pressure or entry (e.g., inter-stand) tension can be used to determine the vertical speed of the roll stack. A force proportional to the stack vertical speed can be generated using a piezoelectric actuator (e.g., piezoelectric assist). This force can provide additional damping, thereby increasing the (third octave) chatter-free speed of the rolling mill.

Different arrangements of the components depicted in the drawings or described above, as well as components and steps not shown or described are possible. Similarly, some features and sub-combinations are useful and may be employed without reference to other features and sub-combinations.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a two (or more) stand tandem cold mill having a roll force hydraulic cylinder comprising a volume of hydraulic fluid, the tandem cold mill comprising: a pressure sensor coupled to the roll force hydraulic cylinder to measure a pressure within the roll force hydraulic cylinder, a piezoelectric actuator coupled to the roll force hydraulic cylinder to act on the volume of hydraulic fluid, and a control system for controlling the piezoelectric actuator in response to inter-stand strip tension disturbances occurring at a frequency of third octave mill stand resonance typically in a range of approximately 90-300 hertz.

Example 2 is a two (or more) stand tandem cold mill for processing a strip of metal having an entry strip tension and having a roll force hydraulic cylinder comprising a volume of hydraulic fluid, the tandem cold mill comprising: a sensor for measuring the entry strip tension, a piezoelectric actuator coupled to the roll force hydraulic cylinder to act on the volume of hydraulic fluid, and a control system for controlling the piezoelectric actuator in response to inter-stand strip tension disturbances occurring at a frequency of third octave mill stand resonance typically in a range of approximately 90-300 hertz.

Example 3 is the mill of example 1, wherein the frequency of third octave mill stand resonance is typically in the range of approximately 90-200 hertz.

Example 4 is the mill of example 2, wherein the frequency of third octave mill stand resonance is typically in the range of approximately 90-200 hertz.

Example 5 is a cold mill having a roll force hydraulic cylinder comprising a volume of hydraulic fluid, the cold mill comprising: a pressure sensor coupled to the roll force hydraulic cylinder to measure a pressure within the roll force hydraulic cylinder, a piezoelectric actuator coupled to the roll force hydraulic cylinder to act on the volume of hydraulic fluid, and a control system for controlling the piezoelectric actuator in response to disturbances occurring at a frequency of third octave mill stand resonance typically in a range of approximately 90-300 hertz.

Example 6 is a method of controlling self-sustaining disturbances occurring at a frequency of third octave mill stand resonance typically in a range of approximately 90-300 hertz in a cold mill having a roll force hydraulic cylinder comprising a volume of hydraulic fluid, the method comprising: measuring a pressure of the hydraulic fluid in the roll force hydraulic cylinder, calculating a desired change in the hydraulic fluid pressure and generating a control signal in response to inter-stand strip tension disturbances occurring at the frequency of third octave mill stand resonance typically in the range of approximately 90-300 hertz, and supplying the control signal to a piezoelectric actuator coupled to the roll force hydraulic cylinder to act on the volume of hydraulic fluid.

Example 7 is a method of controlling self-sustaining disturbances occurring at a frequency of third octave mill stand resonance typically in a range of approximately 90-300 hertz in a cold mill having a roll force hydraulic cylinder comprising a volume of hydraulic fluid, the method comprising: measuring an entry strip tension, calculating a desired change in the hydraulic fluid pressure and generating a control signal in response to inter-stand strip tension disturbances occurring at the frequency of third octave mill stand resonance typically in the range of approximately 90-300 hertz, and supplying the control signal to a piezoelectric actuator coupled to the roll force hydraulic cylinder to act on the volume of hydraulic fluid.

Example 8 is a cold-rolling mill with reduced chatter, comprising a mill stand having a top work roll and a bottom work roll between which a metal strip can be passed, the mill stand comprising a hydraulic cylinder mechanically coupled to provide rolling force to the top work roll; a piezoelectric assist coupled to the hydraulic cylinder for changing a volume of a fluid chamber of the hydraulic cylinder; and a controller coupled to a sensor selected from the group consisting of a pressure sensor of the hydraulic cylinder and a strip tension sensor, wherein the controller is further coupled to the piezoelectric assist for inducing changes in the volume of the fluid chamber in response to linear movement of the top work roll.

Example 9 is the mill of example 8, wherein the piezoelectric assist is coupled to the hydraulic cylinder for changing the volume of the fluid chamber of the hydraulic cylinder at rates at or above approximately 90 hertz.

Example 10 is the mill of examples 8 or 9, wherein the sensor is the pressure sensor and the controller is operable to determine linear movement of the top work roll based on signals from the pressure sensor.

Example 11 is the mill of examples 8 or 9, wherein the sensor is the strip tension sensor and the controller is operable to determine linear movement of the top work roll based on signals from the strip tension sensor.

Example 12 is the mill of examples 11, wherein the strip tension sensor is at least one load cell coupled to a roller positionable proximal the mill stand.

Example 13 is the mill of examples 8-12, wherein the controller includes a high pass filter for filtering out signals below approximately 90 hertz.

Example 14 is a method comprising passing a metal strip between a top work roll and a bottom work roll of a mill stand; applying a rolling force to the top work roll by a hydraulic cylinder; measuring a parameter of the mill stand, wherein the parameter is a hydraulic pressure of the hydraulic cylinder or an entry tension of the strip; determining vertical movement of the top work roll using the parameter; and actuating a piezoelectric assist to change a volume of the hydraulic cylinder in response to the vertical movement of the top work roll.

Example 15 is the method of example 14, further comprising determining a corrective force to apply to the top work roll based on the vertical movement of the top work roll, wherein actuating the piezoelectric assist is done based on the determined corrective force.

Example 16 is the method of examples 14 or 15, wherein actuating the piezoelectric assist is performed at a speed at or above approximately 90 hertz.

Example 17 is the method of examples 14-16, wherein the parameter is the hydraulic pressure of the hydraulic cylinder.

Example 18 is the method of examples 14-16, wherein the parameter is the entry tension of the strip.

Example 19 is the method of examples 14-18, wherein determining the vertical movement of the top work roll comprises rejecting movements occurring below approximately 90 hertz.

Example 20 is the method of examples 14-19, further comprising calculating a desired change in hydraulic fluid pressure of the hydraulic cylinder in response to the vertical movement of the top work roll, wherein actuating the piezoelectric assist is done based on the calculated desired change in hydraulic fluid pressure.

Example 21 is the method of example 20, wherein the desired change is calculated to reduce third octave vibration in the mill stand.

Example 22 is a method comprising passing a metal strip between a top work roll and a bottom work roll of a mill stand; applying a rolling force to the top work roll by a hydraulic cylinder having a volume of hydraulic fluid; determining vertical movement of the top work roll in a third octave range, wherein determining the vertical movement comprises calculating vertical movement based on a measurement of pressure of the hydraulic fluid or entry tension of the metal strip; calculating a desired change in the pressure of the hydraulic fluid; and applying force to the volume of hydraulic fluid based on the calculated desired change, wherein applying force to the volume of hydraulic fluid comprises actuating a piezoelectric actuator coupled to the hydraulic cylinder.

Example 23 is the method of example 22, further comprising sensing the pressure of the hydraulic fluid, wherein the vertical movement is calculated based on the sensed pressure of the hydraulic fluid.

Example 24 is the method of example 22, further comprising sensing the entry tension of the metal strip, wherein the vertical movement is calculated based on the sensed entry tension of the metal strip.

Example 25 is the method of examples 22-24, wherein determining the vertical movement of the top work roll comprises filtering out movements below approximately 90 hertz.

Example 26 is the method of examples 22-25, wherein applying force to the volume of hydraulic fluid is performed at a speed at or above approximately 90 hertz.

Example 27 is the method of examples 22-26, wherein the desired change is calculated to reduce third octave vibration in the mill stand.

What is claimed is:

1. A cold-rolling mill with reduced chatter, comprising:

a mill stand having a top work roll and a bottom work roll between which a metal strip can be passed, the mill stand comprising a hydraulic cylinder mechanically coupled to provide a rolling force to the top work roll, wherein the mill stand has damping contributing to a process damping associated with using the mill stand to reduce a thickness of the metal strip at a mill speed, and wherein a reduction in the process damping is associated with an increase in the mill speed;

a piezoelectric assist coupled to the hydraulic cylinder for changing a volume of a fluid chamber of the hydraulic cylinder to introduce additional damping to the process damping; and a controller coupled to a sensor selected from the group consisting of a pressure sensor of the hydraulic cylinder and a strip tension sensor, wherein the controller is further coupled to the piezoelectric assist for inducing changes in the volume of the fluid chamber in response to linear movement of the top work roll to introduce the additional damping in an amount sufficient to offset the reduction in the process damping and maintain the process damping at a positive amount of damping to avoid third octave chatter of the mill stand.

2. The cold-rolling mill of claim 1, wherein the piezoelectric assist is coupled to the hydraulic cylinder for changing the volume of the fluid chamber of the hydraulic cylinder at rates at or above approximately 90 hertz.

3. The cold-rolling mill of claim 1, wherein the sensor is the pressure sensor and the controller is operable to determine linear movement of the top work roll based on signals from the pressure sensor.

4. The cold-rolling mill of claim 1, wherein the sensor is the strip tension sensor and the controller is operable to determine linear movement of the top work roll based on signals from the strip tension sensor.

5. The cold-rolling mill of claim 4, wherein the strip tension sensor is at least one load cell coupled to a roller positionable proximal the mill stand.

6. The cold-rolling mill of claim 1, wherein the controller is configured to:

calculate a pressure signal using the linear movement of the top work roll;

determine a force to apply through the piezoelectric assist using the pressure signal, wherein the force is calculated to provide the additional damping sufficient to avoid the third octave chatter of the mill stand; and supply a control signal to the piezoelectric assist to apply the force through the piezoelectric assist.

7. The cold-rolling mill of claim 6, wherein the controller includes a high pass filter for filtering out signals below approximately 90 hertz, and wherein the controller is further configured to filter the pressure signal through the high pass filter before determining the force to apply through the piezoelectric assist.

8. A method, comprising:

passing a metal strip between a top work roll and a bottom work roll of a mill stand having damping contributing to a process damping associated with using the mill stand to reduce a thickness of the metal strip at a mill speed, wherein a reduction in the process damping is associated with an increase in the mill speed;

applying a rolling force to the top work roll by a hydraulic cylinder;

measuring a parameter of the mill stand, wherein the parameter is a hydraulic pressure of the hydraulic cylinder or an entry tension of the metal strip;

determining vertical movement of the top work roll using the parameter; and actuating a piezoelectric assist to change a volume of the hydraulic cylinder in response to the vertical movement of the top work roll to introduce additional damping in an amount sufficient to offset the reduction in the process damping and maintain the process damping at a positive amount of damping to avoid third octave chatter of the mill stand.

9. The method of claim 8, further comprising determining a corrective force to apply to the top work roll based on the vertical movement of the top work roll, wherein actuating the piezoelectric assist is done based on the determined corrective force, and wherein the corrective force is calculated to provide the additional damping sufficient to avoid the third octave chatter of the mill stand.

10. The method of claim 8, wherein actuating the piezoelectric assist is performed at a speed at or above approximately 90 hertz.

11. The method of claim 8, wherein the parameter is the hydraulic pressure of the hydraulic cylinder.

12. The method of claim 8, wherein the parameter is the entry tension of the strip.

13. The method of claim 8, wherein determining the vertical movement of the top work roll comprises rejecting movements occurring below approximately 90 hertz.

14. The method of claim 8, further comprising calculating a desired change in hydraulic fluid pressure of the hydraulic cylinder in response to the vertical movement of the top work roll, wherein actuating the piezoelectric assist is done based on the calculated desired change in hydraulic fluid pressure.

15. The method of claim 14, wherein calculating the desired change comprises:

calculating a pressure signal using the vertical movement of the top work roll;

determining a force to apply through the piezoelectric assist using the pressure signal, wherein the force is calculated to provide the additional damping sufficient to avoid the third octave chatter of the mill stand; and determining the desired change necessary to effect the determined force through the piezoelectric assist.

16. A method, comprising:

passing a metal strip between a top work roll and a bottom work roll of a mill stand having damping contributing to a process damping associated with using the mill stand to reduce a thickness of the metal strip at a mill speed, wherein a reduction in the process damping is associated with an increase in the mill speed;

applying a rolling force to the top work roll by a hydraulic cylinder having a volume of hydraulic fluid;

determining vertical movement of the top work roll based on a measurement of pressure of the hydraulic fluid or entry tension of the metal strip; and supplying supplemental damping to the process damping to avoid third octave chatter of the mill stand, wherein supplying supplemental damping comprises:

determining an amount of supplemental damping sufficient to offset the reduction in the process damping and maintain the process damping at a positive amount of damping;

calculating a desired change in the pressure of the hydraulic fluid using the determined amount of supplemental damping; and applying force to the volume of hydraulic fluid based on the calculated desired change, wherein applying force to the volume of hydraulic fluid comprises actuating a piezoelectric actuator coupled to the hydraulic cylinder.

17. The method of claim 16, further comprising sensing the pressure of the hydraulic fluid, wherein the vertical movement is calculated based on the sensed pressure of the hydraulic fluid.

18. The method of claim 16, further comprising sensing the entry tension of the metal strip, wherein the vertical movement is calculated based on the sensed entry tension of the metal strip.

19. The method of claim 16, wherein determining the vertical movement of the top work roll comprises filtering out movements below approximately 90 hertz.

20. The method of claim 16, wherein applying force to the volume of hydraulic fluid is performed at a speed at or above approximately 90 hertz.

* * * * *